United States Patent [19]

Huff

[11] 4,425,003

[45] Jan. 10, 1984

[54] SINGLE WELL-MULTIPLE CAVITY SOLUTION MINING OF AN INCLINED STRUCTURE

[75] Inventor: Clark H. Huff, Moab, Utah

[73] Assignee: Texasgulf Inc., Stamford, Conn.

[21] Appl. No.: 318,104

[22] Filed: Nov. 4, 1981

[51] Int. Cl.[3] ..... E21B 43/28
[52] U.S. Cl. ..... 299/5; 166/50
[58] Field of Search ..... 299/4, 5; 166/50

[56] References Cited

U.S. PATENT DOCUMENTS

| | | | |
|---|---|---|---|
| 2,682,396 | 6/1954 | Haworth | 299/5 X |
| 2,822,158 | 2/1958 | Brinton | 299/4 |
| 3,341,252 | 9/1967 | Dahms et al. | 299/4 |
| 4,290,650 | 9/1981 | Thompson | 299/4 |

*Primary Examiner*—Ernest R. Purser
*Attorney, Agent, or Firm*—Denis A. Polyn

[57] ABSTRACT

A method of solution mining a bed of soluble ore disposed in a sloping subterranean strata disposed beneath an insoluble stratum by developing contemporaneous multiple cavities through the same borehole.

7 Claims, 1 Drawing Figure

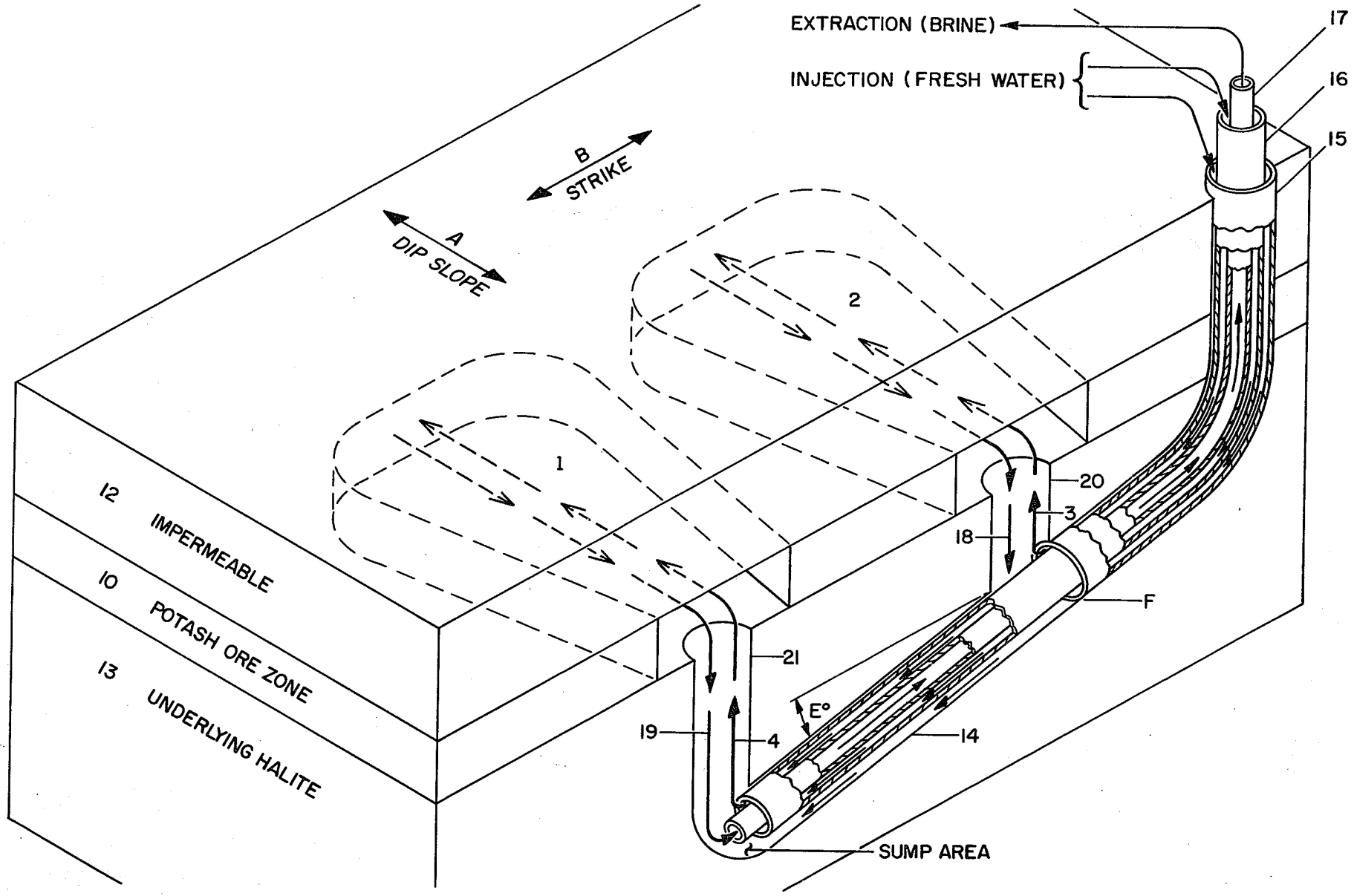
17
16
15
EXTRACTION (BRINE)
INJECTION (FRESH WATER)
F
20
3
18
14
SUMP AREA
2
E°
21
4
19
B
STRIKE
1
A
DIP SLOPE
12 IMPERMEABLE
10 POTASH ORE ZONE
13 UNDERLYING HALITE

SINGLE WELL-MULTIPLE CAVITY SOLUTION MINING OF AN INCLINED STRUCTURE

SUMMARY OF THE INVENTION

This invention provides a method for establishing two or more cavities contemporaneously using a single well, from which to solution mine an inclined ore zone overlain by an insoluble strata and underlain by a thick soluble zone. Using established and proven drilling techniques, the borehole is drilled in a direction approximately parallel to the strike of the deposit with enough accumulative angle in order that it will enter the soluble bed underlying the ore zone in a near horizontal position. The drilling is continued at this level in a nearly horizontal but preferably slightly downward plane for some distance. The borehole is then cased and strings of tubing are placed at selected intervals to allow the solution cavities to develop. Openings with approximately vertical orientations are dissolved upward through the soluble bed into the overlying ore zone by injecting fresh water through the given strings of tubing. Solution mining of the ore zone can then commence. The denser, loaded brine migrates down through the openings of the cavities and is extracted through a string of pipe common to the cavities.

DESCRIPTION OF THE PREFERRED EMBODIMENT

Referring to the drawing, a typical ore formation is shown for which the method of the present invention is particularly adapted. The formation shown in exemplary of the saline deposits of the Paradox Basin in southeast Utah. The rich but structurally deformed deposits of sylvinite (KCl.NaCl) within the Paradox Formation in that area have been known for many years. Basically, the Paradox Formation contains several zones of interbedded and potentially economic potash zones, and many of these are capped by a thick, insoluble rock zone. All are underlain by a thick layer of nearly pure halite (NaCl) or rock salt. The present invention, as will be described more fully below, takes advantage of this inclined orientation of the deposit, insoluble layer above the ore horizon and the thick, underlying salt beds to develop an effective and efficient mining system, even in spite of the fact that some of the mineralization of interest is below 7,000 feet.

The primary salt of interest is sylvinite (KCl-NaCl). However, this solution mining invention could also be used to mine double salts such as carnallite (KCl-$MgCl_2.6H_2O$), or any other soluble mineral found in a situation described above.

In a typical view of the formation shown in the drawing, the extractable ore zone (10) is located below ground level and slopes upwardly in the dip direction, i.e. from right to left, and as indicated by Arrow A. The strike direction, i.e. at a right angle to the dip direction, is indicated by Arrow B.

Within a few feet of the top of the ore zone (10) is the impermeable and insoluble rock zone (12) of shale, dolomite, anhydrite or the like. Immediately below the ore zone (10) is a thick salt halite zone (13).

The drill hole (14) extends vertically downward from ground level to a predetermined point above the ore zone. At this point, using established and proven drilling techniques, the well is drilled approximately on strike with the deposit using enough accumulative angle in order that the borehole will enter the salt zone (13) at a near horizontal attitude, i.e. angle E as shown on the drawing. The drilling is continued at this low angle from the horizontal in the salt zone (13) for a determined distance.

The borehole is cased as shown in the drawing. The main casing (15) is cemented in place at Point F as shown. For two cavity development, selected tubings (16 and 17) are hung inside of the main casing (15) and run out through the casing into the open borehole (14) as depicted. After the cemented casing is in place, the drill hole (14) is extended in a nearly horizontal attitude for a predetermined distance to allow room for cavity development.

In initial operation, fresh water is injected through the annular space between the casing (15) and the outer tubing (16) and also through the annular space between the outer tubing (16) and the inner tubing (17). The injected fluid, being less dense than the brine in the borehole will flow upward to the first solid layer encountered. During the initial operation of the system, the first zone encountered in the underlying halite (13) surrounding the borehole (14). The water, being undersaturated with respect to the salt, will immediately dissolve the contacted halite. The brine formed by dissolution (18 and 19), being more dense than the injected fluid (3 and 4), will gradually move downward as it is replaced by the less dense injected fluid. The brine is eventually forced to the extraction tubing located at or near the sump area. The continued action of the upward flowing injection fluid (3 and 4) will develop a "chimney" (20 and 21) extending upward from the termination of the annular space used for injection. The chimneys (20 and 21) formed will be of a suitable size to allow both injection water (3 and 4) to rise and the extraction brine (18 and 19) to fall with only minimal intermixing of fluids. After these openings are completed, the actual solution mining of the ore zone (10) is started.

In operation, fresh water is injected into mining cavities 1 and 2 through, respectively, pipes 15 and 16. The water (3 and 4) is discharged into the chimneys (20 and 21) and flows upward into the cavities in the directions shown on the drawing. The injected water flows upward in the chimneys since the water is less dense than the partially or fully saturated brine presently in the cavities. The solution mining of the cavities then takes place. The loaded brine, being the most dense fluid present, flows back downdip along the floor of the cavities (1 and 2) and down the chimneys (20 and 21). The brine from cavity is forced along the open borehole (14) to the sump below cavity 1 and is extracted along with the brine from cavity through tubing 17.

Although only a two-cavity system is shown in the drawing, a greater number of cavities could be developed by varying the number of strings of tubing.

I claim:

1. A method of solution mining a bed of soluble ore disposed in sloping subterranean strata disposed beneath an insoluble stratum by developing contemporaneous multiple cavities through the same borehole which comprises the steps of:

(a) establishing a borehole generally along the formation strike, directionally drilled to a nearly horizontal attitude for a determined distance in the soluble zone just below the ore zone of interest;

(b) injecting solvent into prortions of said horizontal borehole through the annular tubing spaces in such a manner that two or more chimneys will be developed in the soluble zone below the ore zone of interest, exposing said ore zone of said solvent;

(c) injecting solvent into said annular tubing spaces in said borehole in such a manner that the solvent will be directed in an updip direction beneath said insoluble zone and within said ore zone to develop cavities with mining faces remote from said borehole;

(d) withdrawing solvent with dissolved ore through said borehole at a sump area;

(e) adjusting such withdrawal to provide for down flow of the solvent across said mining faces and downwardly in a downdip direction along the floors of said cavities to said exit point at a rate sufficient to extract said ore stratum without appreciable mining of vertically adjacent strata; and, (f) developing additional cavities along the nearly horizontal portion of said borehole, as space permits and as previous solution mining cavities are depleted.

2. In the method of claim 1, only one chimney/solution mining cavity is operated at a time in said borehole.

3. In the method of claims 1 or 2, said injection into boreholes being adjusted to develop said chimneys and cavities away from borehole casings to provide greater protection for the casings thus greatly extending the life of the system.

4. In the method of claims 1 or 2, said solvent being water or a solution unsaturated in at least one salt at the temperature of the cavity.

5. In the method of claim 4, said ore being rich in at least one soluble salt selected from the group consisting of sodium, calcium, magnesium, and potassium salts.

6. In the method of claim 4, said ore being rich in sylvinite.

7. In the method of claim 4, said ore zone and underlying zone both being halite (NaCl).

* * * * *